US005896587A

United States Patent [19]

Gentry

[11] Patent Number: 5,896,587

[45] Date of Patent: Apr. 27, 1999

[54] SUN SHIELD HELMET ASSEMBLY FOR BICYCLIST

[76] Inventor: Debra Gentry, 6321 Golding Dr., Lancaster, Calif. 93536

[21] Appl. No.: 08/870,797

[22] Filed: Jun. 6, 1997

Related U.S. Application Data

[63] Continuation-in-part of application No. 08/584,528, Jan. 11, 1996, abandoned.

[51] Int. Cl.[6] ..... A42B 3/00

[52] U.S. Cl. ..... 2/425; 2/422; 2/12

[58] Field of Search ..... 2/410, 411, 421, 2/422, 425, 12

[56] References Cited

U.S. PATENT DOCUMENTS

| | | | |
|---|---|---|---|
| 4,192,017 | 3/1980 | Fay | 2/12 |
| 4,209,858 | 7/1980 | Coenen | 2/412 |
| 4,575,875 | 3/1986 | Dawson et al. | 2/424 |
| 4,622,700 | 11/1986 | Sundahl | 2/425 |
| 4,653,123 | 3/1987 | Broersma | 2/425 |
| 5,070,545 | 12/1991 | Tapia | 2/12 |
| 5,083,321 | 1/1992 | Davidsson | 2/421 |
| 5,099,524 | 3/1992 | Linday | 2/181 |
| 5,173,970 | 12/1992 | Shifrin | 2/410 |
| 5,177,810 | 1/1993 | Minton et al. | 2/10 |
| 5,201,077 | 4/1993 | Dondlinger | 2/199 |
| 5,333,328 | 8/1994 | Roberts | 2/422 |

FOREIGN PATENT DOCUMENTS

| | | | |
|---|---|---|---|
| 2508777 | 1/1983 | France | 2/422 |

*Primary Examiner*—Michael A. Neas

[57] ABSTRACT

A bicycle helmet having a transparent eye shade and various interchangeable sun shield portions, along with affixed sun shield portions, also including a helmet with a built in sun shield. Sticker or stickers of various styles can be connected to all eye shade portions of the assemblage.

3 Claims, 6 Drawing Sheets

SUN SHIELD HELMET ASSEMBLY FOR BICYCLIST

This is a continuation-in-part of application Ser. No. 08/584,528, filed Jan. 11, 1996, now abandoned.

BACKGROUND

1. Field of Invention

This invention relates to bicycle helmets, specifically to a transparent sun shield for a bicycle helmet.

2. Description of Prior Art

Presently, bicycle helmets do not have sun shields. Currently, some bicycle helmets are made with visors. An example is the visored bicycle helmet in U.S. Pat. No. 5,333,328 to Roberts (1994). Visored bicycle helmets give a bicyclist eye protection against harmful ultraviolet rays. But, visors also block the upper peripheral view of the bicyclist, since visors are not transparent.

OBJECTS AND ADVANTAGES

The sun shield helmet assembly with eye shade portion made of material suitable to block out harmful ultraviolet radiation would protect the eyes from harmful exposure to the sun. In addition the interchangeable sun shields provide an added advantage, the wearer could change sun shields. If the bicyclist wanted to wear a blue sun shield on the helmet today and a green sun shield tomorrow, this could be accomplished with the interchangeable sun shields. Additionally, the interchangeable sun shields can be removed altogether, if the need for speed was a factor, like in professional racing. Since all of the eye shade portions of the sun shield helmet assembly are transparent they will not block the vision of the bicyclist. Further, the assembly can include a sticker or stickers attached to the eye shade portion, in an assortment of different colors, shapes and styles.

More objects and advantages of my invention will become apparent from consideration of the drawings and ensuing description.

DRAWING FIGURES

In the drawings, identical figures have the same number.

REFERENCE NUMERALS IN DRAWINGS

Figure 1:
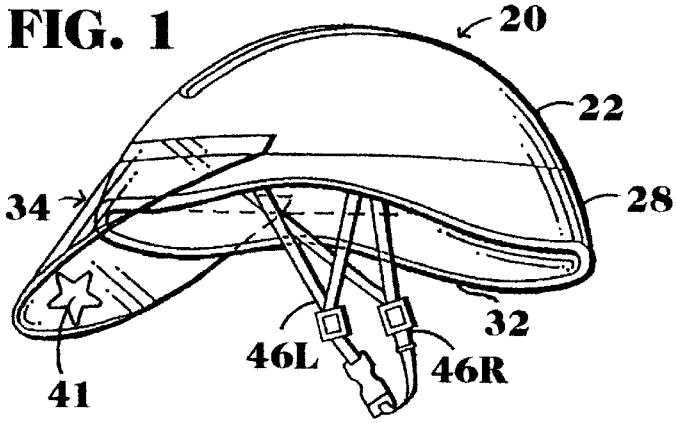
FIG. 1 is a perspective view of a bicycle helmet including an interchangeable sun shield.

20 helmet apparatus
22 shell
24 a front arcuate portion of shell
24*a* outside surface of 24
24*b* inside surface of 24
26 bottom shell rim
28 inner base
30 a front arch portion of inner base
30*a* outside surface of 30
30*b* inside surface of 30
32 bottom inner base rim
34 sun shield apparatus
36 a rear arcuate portion of sun shield
36*a* outside surface of 36
36*b* inside surface of 36
38 eye shade
40 rear sun shield edge
41 sticker
42 front sun shield edge
44 first engagement members strip (loop)
44*a* second engagement members strip (hook)
46L left fastening strap
46R right fastening strap
48 snap or pop type engagement member (male)
48*a* snap or pop type engagement member (female)
50 helmet apparatus
52 shell
54 a front arcuate portion of shell
54*a* outside surface of 54
54*b* inside surface of 54
56 bottom shell rim
58 inner base
60 bottom inner base rim
62 sun shield apparatus
64 a rear arcuate portion of sun shield
64*a* outside surface of 64
64*b* inside surface of 64
66 eye shade
68 rear sun shield edge
69 sticker

70 front sun shield edge
72L left fastening strap
72R right fastening strap
74 adhesive
76 helmet apparatus
78 sun shield shell
80 a circumferential portion of sun shield shell
80*a* outside surface of 80
80*b* inside surface of 80
81 eye shade edge
82 eye shade
83 sticker
84 adhesive
86 material
88L left vent hole
90 chin strap system
90*a* top front section
90*b* top rear section
91 strap end
92L left fastening strap
92R right fastening strap
93 strap adjuster
94 bifurcated male end
94*a* bifurcated female end
95 billet
96 inner protective base
98 a circumferential portion of base
98*a* outside surface of 98
98*b* inside surface of 98
100 apex
100*a* front portion
100*b* rear portion
102 base edge
104 material
106L left vent hole
106R right vent hole

SUMMARY OF THE INVENTION

An object of the invention is to provide protection for the eyes against harmful ultraviolet radiation, without blocking the vision.

Another object is to provide a detachably interconnected, interchangeable transparent sun shield on a bicycle helmet, with an option to include sticker or stickers on the eye shade portion of the sun shield.

Still another object is to provide an affixed transparent sun shield on a bicycle helmet with the same option to include sticker or stickers on the eye shade portion of the sun shield.

Yet another object is to provide a new bicycle helmet with a built in sun shield. Also with the same option to include sticker or stickers on the eye shade portion of shell.

DESCRIPTION OF THE INVENTION

FIG. 1 (perspective view) a helmet apparatus 20 with a transparent sun shield apparatus 34 as they appear when interconnected. Shield 34 is detachably interconnected with helmet 20. Helmet 20 is commonly a bicyclist helmet and is accordingly configured. Helmet 20 insofar as the apparatus of the present invention is concerned, includes a protective shell 22 secured to a protective inner base 28. A left fastening strap 46L is secured and extends downwardly from a base rim 32. A right fastening strap 46R is secured and extends downwardly from rim 32. The apparatus of the present form of the invention may also include a sticker 41, which is affixed to the shield apparatus 34 in a manner presently to be described.

Figure 2:
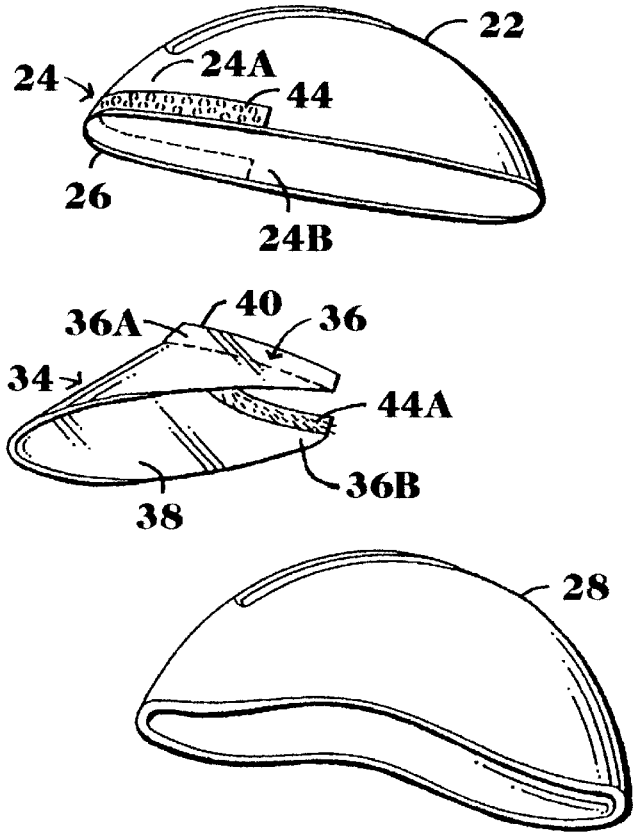
FIG. 2 is a perspective view similar to FIG. 1, but shows the component parts of the apparatus in a disassembled configuration.

In FIG. 2, shell 22 includes a generally arcuate front portion 24. Portion 24 has first and second, or outside and inside surfaces 24*a* and 24*b*. A first engagement members strip 44 of hook and loop material, which may be a multiplicity of a small loop shaped character to which the hook-like members of hook and loop material will releasably interlock. Strip 44 is fixedly attached to outside surface 24*a*, adjacent to a bottom shell rim 26. Sun shield 34 includes an eye shade portion 38 and a generally arcuate rear portion 36. Portion 36 has first and second, or outside and inside surfaces 36*a* and 36*b*. A second engagement members strip 44*a*, which may be a multiplicity of a small hook shaped character is fixedly connected to inside surface 36*b*, adjacent to a rear shield edge 40.

Figure 3:
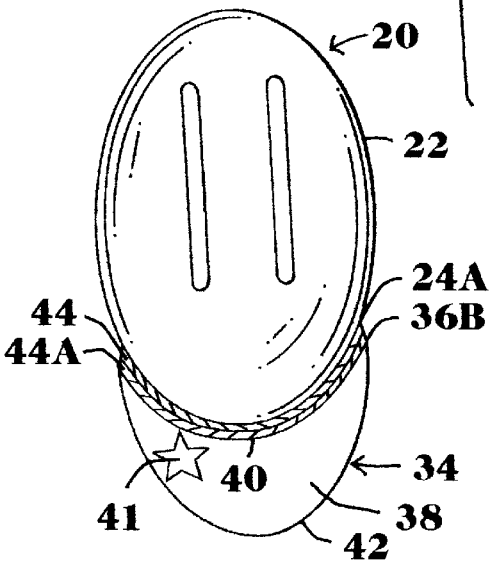
FIG. 3 is a top view of the assembly of FIG. 1, showing the sun shield secured to the helmet.

In FIG. 3 outside surface 24*a* of shell 22 and inside surface 36*b* of shield 34 are provided with a multiplicity of small engagement members of hook and loop material 44 and 44*a*, which detachably interlock to hold surfaces 24*a* and 36*b* in position, causing shield 34 to be maintained securely in place on shell 22. Shield 34 is basically convexed in shape along a front edge 42 and basically concaved in shape along rear edge 40, to conform to the shape of virtually any bicyclist helmet. In the preferred form of the invention transparent shield 34 is of 100% shatterproof, non toxic material suitable for blocking ultraviolet radiation. Shield 34 may be attached to or removed from helmet 20. Additionally shield 34 is interchangeable. A variety of sun shields can be worn on just one helmet. Shield 34 may be replaced by another shield 34 of a different color and/or design. In addition shield 34 may be multicolored.

Also in FIG. 3 the previously identified sticker 41 is fixedly attached to eye shade portion 38. Sticker 41, which is preferably backed with an adhesive material, may be of a variety of materials, shapes, colors and sizes. A plurality of sticker 41 may be used, which is not shown. Sticker 41 is an optional feature on eye shade portion 38 of shield 34.

Figure 4:
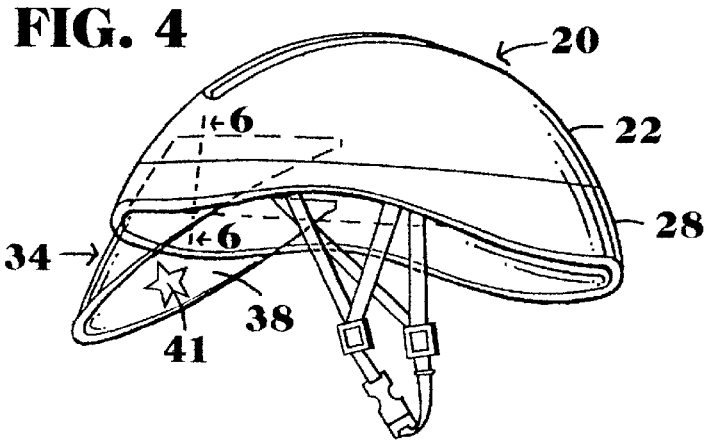
FIG. 4 is a perspective view of a bicycle helmet including an interchangeable sun shield.

Turning now to FIG. 4, the helmet apparatus 20 with transparent shield apparatus 34. This second form of the invention is identical to the first embodiment shown in FIGS. 1 through 3, except for the detachable interlocking position of shield 34 and helmet 20. This second embodiment has the same numbers as the first embodiment to identify the same elements. Shield 34 in now shown interconnected in an inverse position from FIGS. 1, 2, and 3. As with the earlier described embodiment, this form can also include sticker 41, which is affixed to eye shade portion 38 of shield 34. This second form includes sticker 41 in the exact same manner as the first embodiment previously described in FIGS. 1 through 3.

Figure 5:
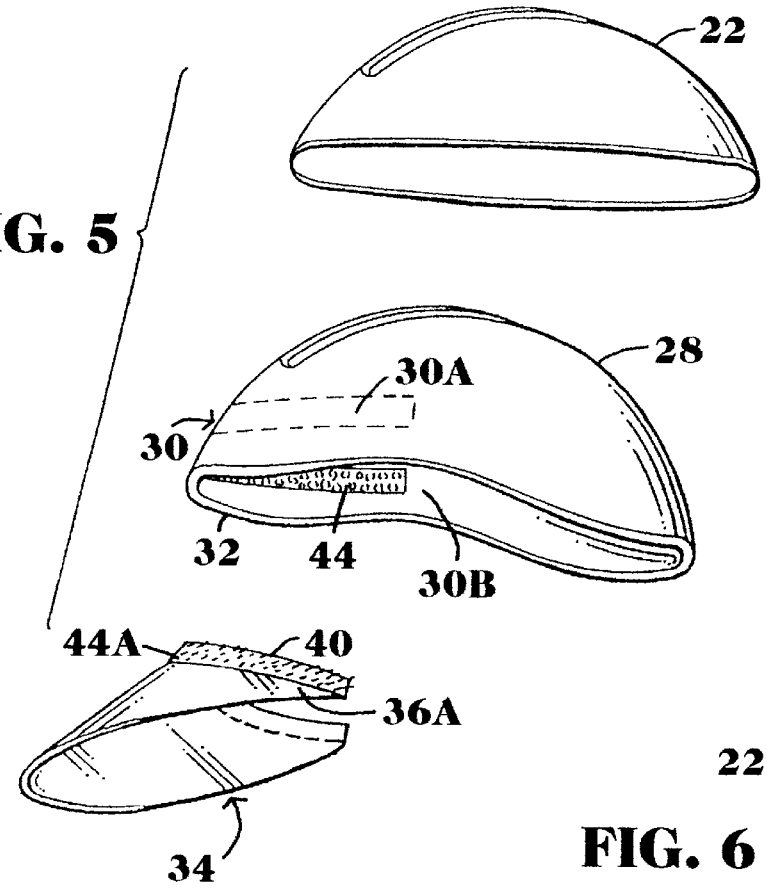
FIG. 5 is a perspective view similar to FIG. 4, but shows the component parts of the apparatus in a disassembled configuration.

Referring to FIG. 5, the inner base 28 includes a generally arched front portion 30. Portion 30 has first and second, or outside and inside surfaces 30*a* and 30*b*. Previously mentioned first engagement member strip 44 is fixedly connected to inside surface 30*b*, slightly adjacent to inner base rim 32. First strip 44 preferably has loop members, of hook and loop material. On sun shield 34, second engagement members strip 44*a* is fixedly connected to outside surface 36*a*, adjacent to rear shield edge 40. Second strip 44*a* preferably has hook members, of hook and loop material.

Figure 6:
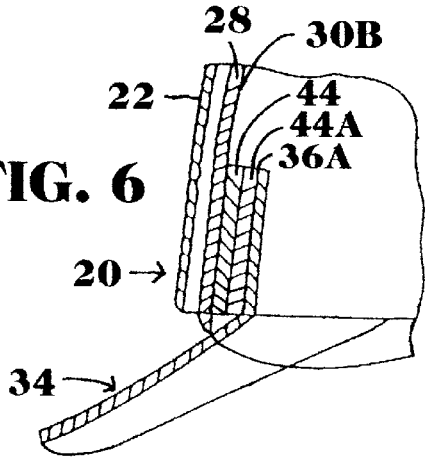
FIG. 6 is an enlarged fragmentary view taken along lines 6—6 of FIG. 4.

In FIG. 6 inside surface 30*b* of inner base 28 and outside surface 36*a* of shield 34 are provided with a multiplicity of small engagement members of hook and loop material 44 and 44*a*, which detachably interlock to hold surfaces 30*b* and 36*a* in position, causing shield 34 to be maintained securely in place on helmet 20. Shield 34 may be removed from or attached to helmet 20, making this alternate form also interchangeable.

Figure 7:
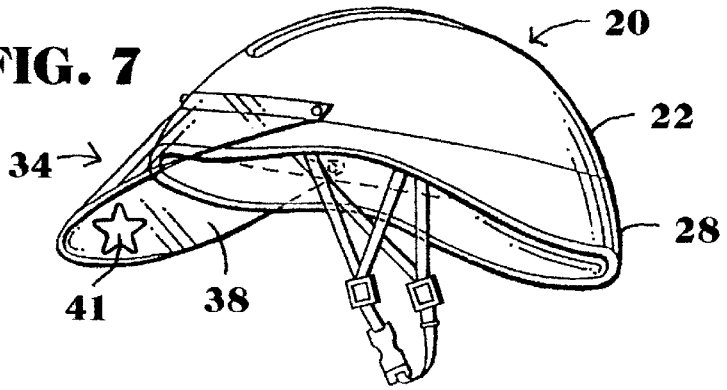
FIG. 7 is a perspective view of a bicycle helmet including an interchangeable sun shield.

Shifting to FIG. 7 (perspective view), helmet apparatus 20 with transparent shield 34 of yet another form of the invention is thereshown. This third form is identical to the first embodiment shown in FIGS. 1 through 3, except for a different means for removably interconnecting the shield 34 to the helmet 20. This third embodiment has the same numbers as the first embodiment to identify the same elements. As with the first described embodiment, this form can also include sticker 41, which is affixed to eye shade portion 38 of shield 34. This third form includes sticker 41 in the exact same manner as the first embodiment previously described in FIGS. 1 through 3.

Figure 8:
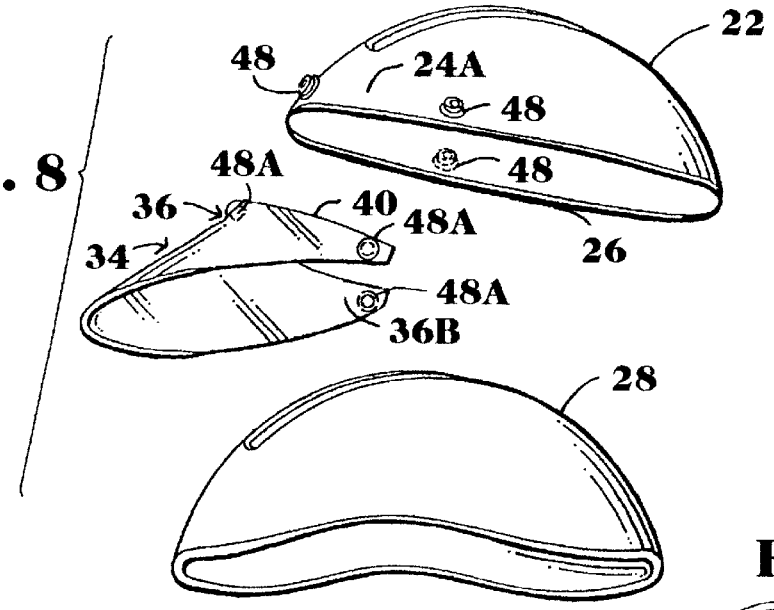
FIG. 8 is a perspective view similar to FIG. 7, but shows the component parts of the apparatus in a disassembled configuration.

In FIG. 8, Previously mentioned shell 22 having outside surface 24*a* of which is provided with a plurality of snap or pop type engagement member 48 to which a plurality of cooperating snap or pop type engagement member 48*a* can be releasably interconnected. Surface 24*a* preferably provided with the male segments of snap or pop type engagement members, adjacent to bottom rim 26. As previously described, shield 34 includes an arcuate rear portion 36 with an inside surface 36*b* of which is provided with a plurality of snap or pop type engagement member 48*a*, adjacent to rear edge 40. Surface 36*b* preferably provided with the female segments of snap or pop type engagement members.

Figure 9:
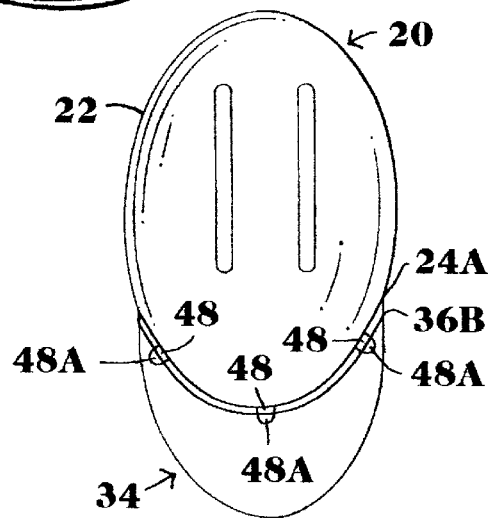
FIG. 9 is a top view of the assembly of FIG. 7, showing the sun shield secured to the helmet.

In FIG. 9 outside surface 24*a* of shell 22 and inside surface 36*b* of shield 34 are provided with a multiplicity of cooperating snap or pop type engagement members 48 and 48*a*, which detachably interlock to hold surfaces 24*a* and 36*b* in position, causing shield 34 to be maintained securely in place on helmet 20. Shield 34 may be removed from or attached to helmet 20, making this third alternate form also interchangeable.

All of the previously mentioned forms of the present invention are interchangeable sun shields. In using the earlier described forms the wearer can change the look of the helmet by removing the sun shield and replacing it with another sun shield.

Figure 10:
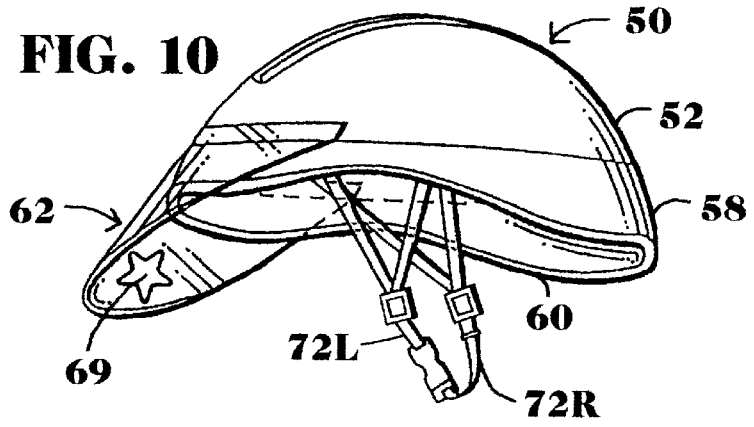
FIG. 10 is a perspective view of a sun shield affixed to a bicycle helmet.

Unlike the previously mentioned forms, this fourth form is not an interchangeable sun shield; but the sun shield is affixed to the helmet apparatus, in a non-rotatable manner. In FIG. 10, the fourth form of the sun shield apparatus of the present invention and the helmet are thereshown. A helmet apparatus 50 with a transparent sun shield apparatus 62 as they appear when connected. Helmet 50 is commonly a bicyclist helmet and is accordingly configured. Helmet 50 insofar as the apparatus of the present invention is concerned, includes a protective shell 52 secured to a protective inner base 58. A left fastening strap 72L is secured and extends downwardly from a base rim 60. A right fastening strap 72R is secured and extends downwardly from rim 60. Like the previous forms of the invention, this fourth form may also include a sticker 69, which is affixed to the shield apparatus 62 in a way presently to be described.

Figure 11:
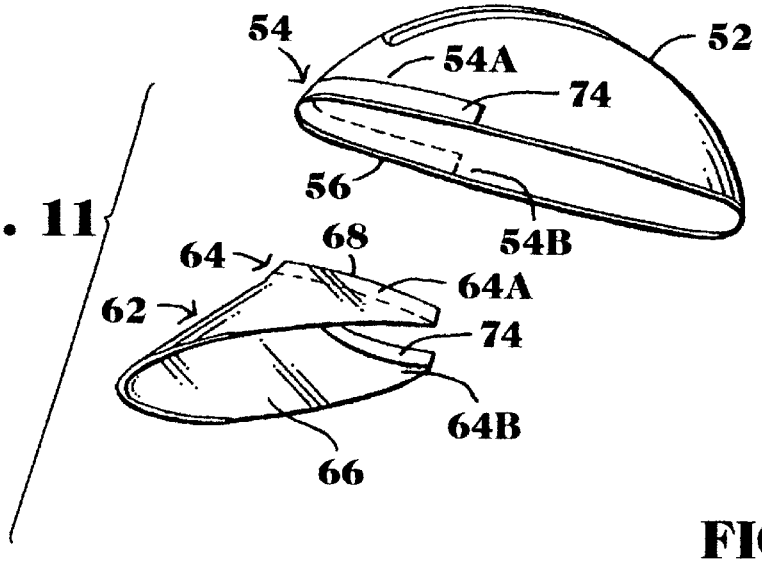
FIG. 11 is a perspective view similar to FIG. 10, but shows the component parts of the apparatus in a disassembled configuration.
Figure 11:
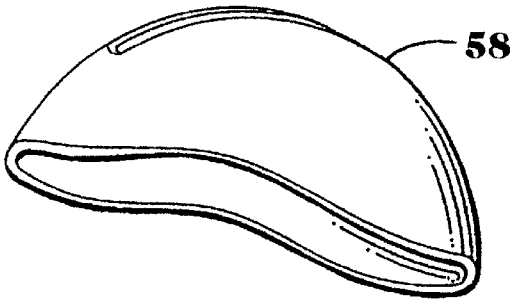

Referring to FIG. 11, shell 52 includes a generally arcuate front portion 54. Portion 54 has first and second, or outside and inside surfaces 54*a* and 54*b*. An adhesive 74 is placed along outside surface 54*a*, alongside a bottom shell rim 56. Sun shield 62 includes an eye shade portion 66 and a rear generally arcuate portion 64. Portion 64 has first and second or outside and inside surfaces 64*a* and 64*b*. Previously mentioned adhesive 74 is also placed along inside surface 64*b*, alongside a rear shield edge 68.

Figure 12:
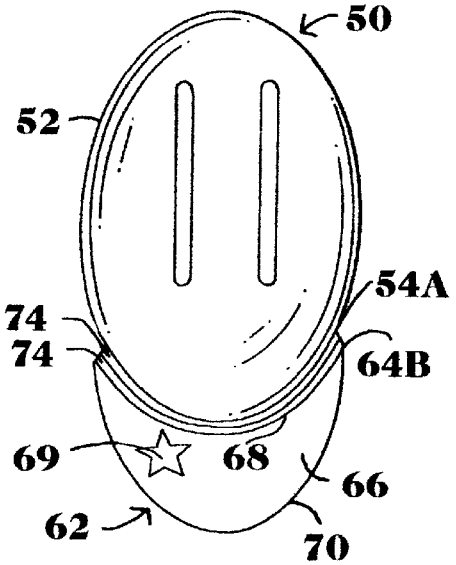
FIG. 12 is a top view of the assembly of FIG. 10, showing the sun shield secured to the helmet.

In FIG. 12 outside surface 54*a* of shell 52 and inside surface 64*b* of shield 62 are placed together at adhesive locations to unite. As with the previous forms of the present invention, shield 62 is generally convexed in shape along a front sun shield edge 70 and generally concaved in shape along rear edge 68, to conform to the shape of virtually any bicyclist helmet. In the preferred form of the invention, transparent shield 62 is of 100% shatterproof, non toxic material suitable for blocking ultraviolet radiation.

Also in FIG. 12 the previously identified sticker 69 may be fixedly attached to eye shade portion 66. Sticker 69, which is preferably backed with an adhesive material, may be of a variety of materials, shapes, colors and sizes. A plurality of sticker 69 may be used, which is not shown. Sticker 69 is an optional feature on eye shade portion 66 of shield 62.

Figure 13:
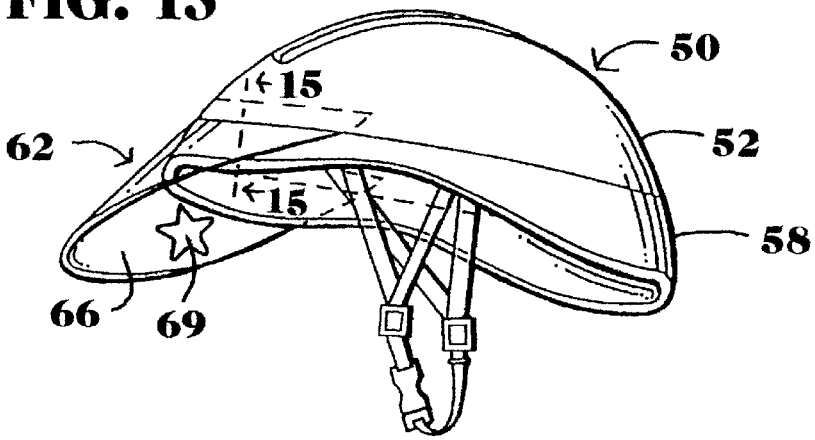
FIG. 13 is a perspective view of a sun shield affixed to a bicycle helmet.

Shifting now to FIG. 13, helmet apparatus 50 with transparent shield apparatus 62. This fifth form of the invention is identical to the fourth embodiment shown in FIGS. 10 through 12, except for the connecting position of shield 62 and helmet 50. This fifth embodiment has the same numbers as the fourth embodiment to identify the same elements. Shield 62 is now in an inverse position from the fourth form in FIGS. 10, 11 and 12. As with the fourth described embodiment, this form can also include sticker 69, which is affixed to eye shade portion 66 of shield 62. This fifth form includes sticker 69 in the exact same manner as the fourth embodiment previously described in FIGS. 10 through 12.

Figure 14:
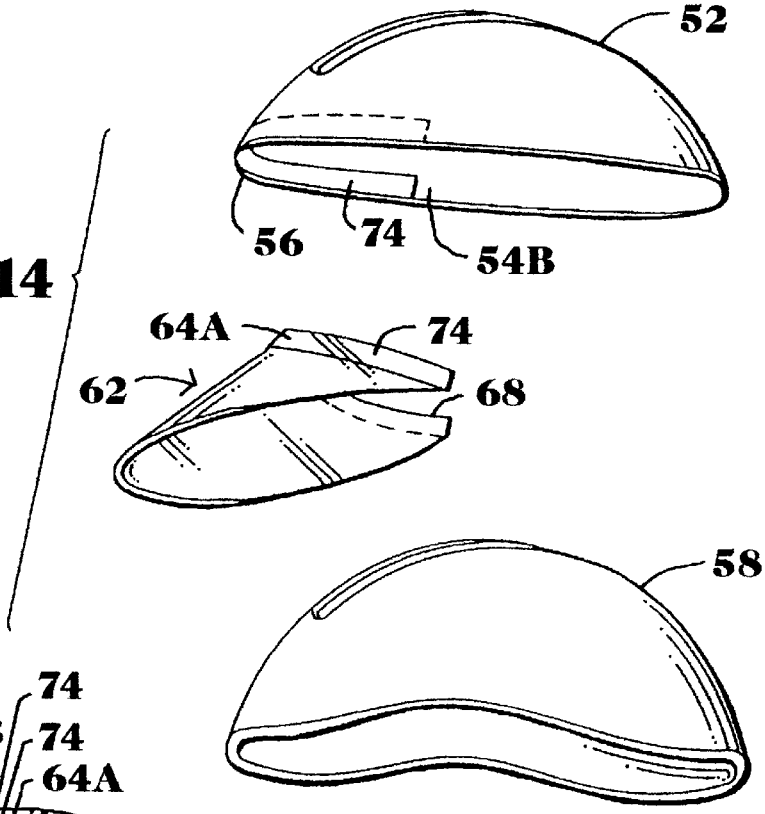
FIG. 14 is a perspective view similar to FIG. 13, but shows the component parts of the apparatus in a disassembled configuration.

In FIG. 14, the previously mentioned shell 52 having inside surface 54*b*. Adhesive 74 is placed along inside surface 54*b*, adjacent to bottom shell rim 56. On sun shield 62 adhesive 74 is placed along outside surface 64*a*, adjacent to rear sun shield edge 68.

Figure 15:
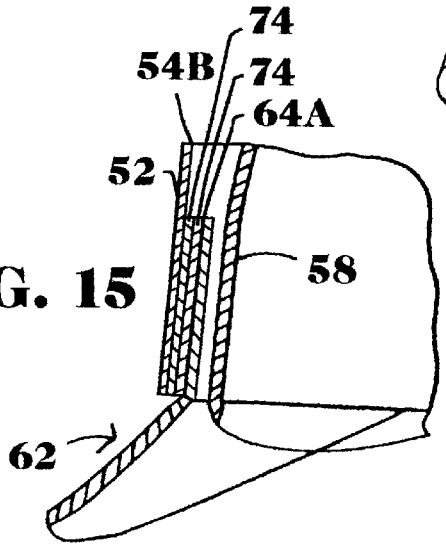
FIG. 15 is an enlarged fragmentary view taken along lines 15—15 of FIG. 13.

In FIG. 15 inside surface 54*b* of shell 52 and outside surface 64*a* of shield 62 are placed together at adhesive locations to unite.

Figure 16:
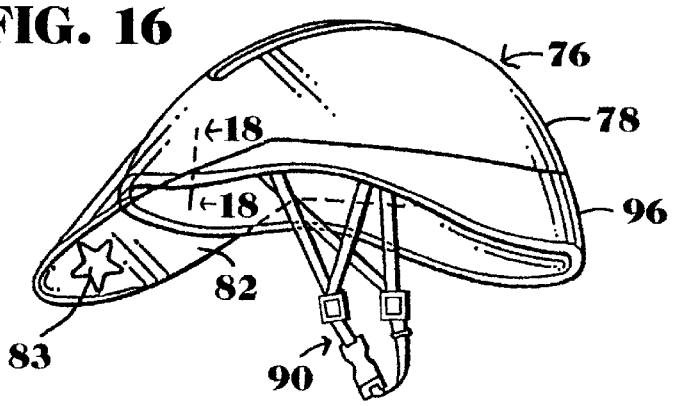
FIG. 16 is a perspective view of a bicycle helmet with a built in sun shield.

Changing now to FIG. 16 (perspective view), this form is substantially different from the forms previously described. The prior art of the helmet apparatus is not used. A helmet apparatus 76 of the present invention, encompasses a transparent sun shield shell 78 and an integral inner protective base 96. Shell 78 and base 96 are shown as they appear when connected, in a non-rotatable manner. The apparatus of the present invention also includes a chin strap 90, which is affixed to base 96. Resembling the previous forms of the invention, this form may also include a sticker 83, which is affixed to shell 78 in a manner presently to be described.

Figure 17:
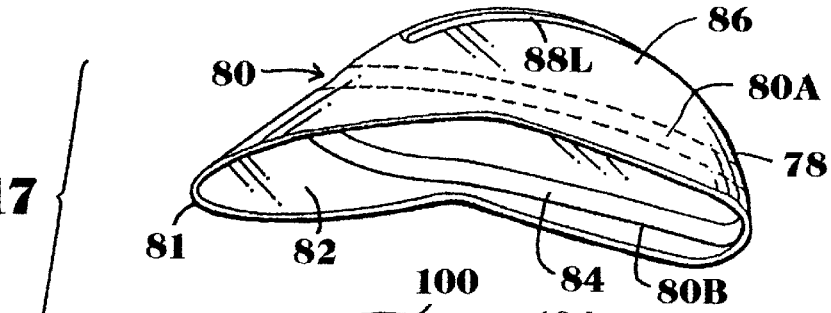
FIG. 17 is a perspective view similar to FIG. 16, but shows the component parts of the apparatus in a disassembled configuration.
Figure 17:
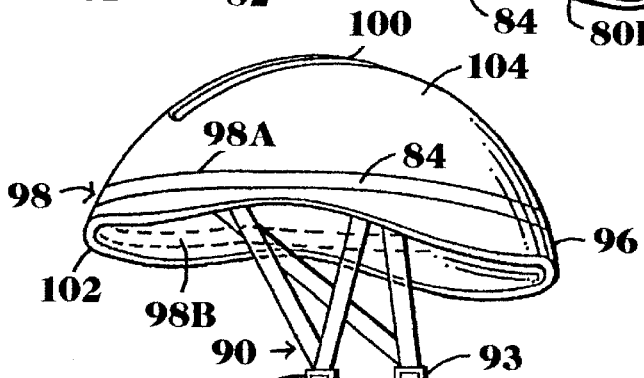

In FIG. 17, Shield shell 78 includes a left vent hole 88L and a right vent hole, which is not shown. Shell 78 also includes a generally circumferential portion 80, which extends around shell 78. Portion 80 has first and second, or outside and inside surfaces 80*a* and 80*b*. An adhesive 84 is placed along inside surface 80*b*. Shell 78 is largely dome like in shape, except for shade portion 82, which is convex shaped, along an eye shade edge 81 and extends outwardly and downwardly. Shell 78 is preferably made of a transparent plastic material 86 or the like. base 96 includes a circumferential portion 98, which extends around base 96. Portion 98 has first and second or outside and inside surfaces 98*a* and 98*b*. Previously mentioned adhesive 84 is also placed along outside surface 98*a*, slightly adjacent to a base edge 102. Base 96 is generally dome shaped, having an apex 100, at the top. Base 96 preferably is made of a styrofoam material 104 or the like.

Figure 18:
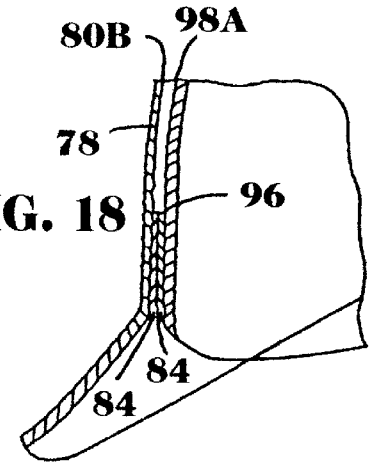
FIG. 18 is an enlarged fragmentary view taken along lines 18—18 of FIG. 16.

In FIG. 18 inside surface 80*b* of shell 78 and outside surface 98*a* of base 96 are placed together at adhesive locations to connect. Adhesive 84 should be made of substance suitable for a connection, preferably a pellucid adhesive.

Figure 19:
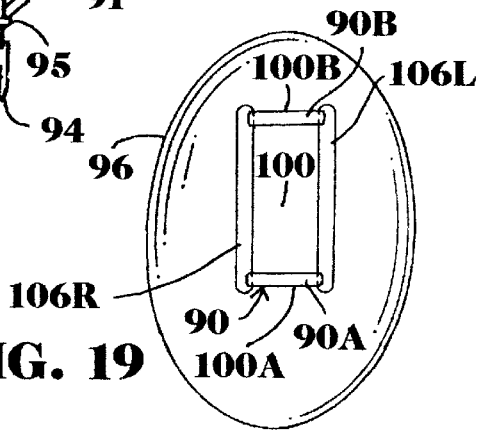
FIG. 19 is a top view of one (1) component part of FIG. 17.

In FIG. 19, base 96 includes apex 100, which incorporates a front portion 100*a* and a rear portion 100*b*. In addition base

96 includes a left vent hole 106L and a right vent hole 106R. Chin strap system 90 includes a top front section 90*a* and a top rear section 90*b*. front section 90*a* is superimposed on front portion 100*a* and is placed through left vent hole 106L and right vent hole 106R. Rear section 90*b* is superimposed on rear portion 100*b* and is also placed through left vent hole 106L and right vent hole 106R. In FIG. 17, on base 96, chin strap system 90 also includes a right fastening strap 92R and a left fastening strap 92L. Right fastening strap 92R preferably having a bifurcated male end 94 extends downwardly from base edge 102. Right fastening strap 92R also includes a strap adjuster 93 and a billet 95. Strap adjuster 93, regulates the length of right strap 92R, permitting the right strap 92R to be shortened or loosened as desired. Billet 95 holds a strap end 91 in position, keeping end 91 from dangling. Left fastening strap 92L preferably having a bifurcated female end 94*a* extends downwardly from base edge 102. Left fastening strap 92L, also includes strap adjuster 93, which regulates the length of the left strap 92L, permitting the left strap 92L to be shortened or loosened as desired. End 94 and end 94*a*, of chin strap system 90, are coupled together by means of conventional male and female interconnecting clip or clasp members.

In FIG. 16, the previously identified sticker 83 may be fixedly attached to eye shade portion 82. Sticker 83, which is preferably backed with an adhesive material, may be of a variety of materials, shapes, colors and sizes. A plurality of sticker 83 may be used, which is not shown. Sticker 83 is an optional feature on eye shade portion 82 of shell 78.

Having now described the invention in detail in accordance with the requirements of the patent statues, those skilled in this art will have no difficulty in making changes and modifications in the individual parts or their relative assembly in order to meet the specific requirements or conditions. Such changes and modifications may be made without departing from the scope and spirit of the invention. An example of a change is with the interchangeable sun shields. The sun shields can have a fabric trimming around the edges. Accordingly, the scope of the invention should be determined not by the embodiment(s) illustrated, but by the appended claims and their legal equivalents.

I claim:

1. A helmet assemblage for bicyclists comprising:

(a) an inner base covering substantially a top portion of wearer's head, (b) an one piece sun shield shell including a transparent eye shade portion, said shell substantially covers said base, said shade portion of said shell extending downwardly below an edge of said inner base, (c) a chin strap, and (d) connection means for connecting said shell, said strap and said base together without rotation of said sun shield shell.

2. The helmet assemblage of claim 1 wherein said connection means is adhesive material connecting said shell and said strap directly to a surface of said base.

3. The helmet of claim 1 wherein at least one sticker is affixed to said shell.

* * * * *